US005313891A

United States Patent [19]

Suttles

[11] Patent Number: 5,313,891

[45] Date of Patent: May 24, 1994

[54] BEVERAGE AISLE UNIT

[75] Inventor: J. Marshall Suttles, Elberton, Ga.

[73] Assignee: The Mead Corporation, Atlanta, Ga.

[21] Appl. No.: 807,984

[22] Filed: Dec. 16, 1991

[51] Int. Cl.[5] ..... A47B 9/00

[52] U.S. Cl. ..... 108/108; 211/186

[58] Field of Search ..... 108/108, 107, 109, 110, 108/111, 144, 152; 211/193, 190, 187, 186; 240/250, 220.2, 225.1, 225.2, 223.3

[56] References Cited

U.S. PATENT DOCUMENTS

| | | | |
|---|---|---|---|
| 2,958,427 | 11/1960 | Bianchi | 108/108 |
| 3,209,709 | 10/1965 | Shoffner | 108/108 X |
| 3,234,897 | 2/1966 | Berk | 108/108 X |
| 3,589,310 | 6/1971 | Tucker | 108/108 |
| 3,983,822 | 10/1976 | Suttles . | |
| 4,064,996 | 12/1977 | Shillum | 108/107 X |
| 4,204,480 | 5/1980 | Hanna . | |
| 4,332,204 | 6/1982 | Hewell . | |
| 4,535,704 | 8/1985 | Suttles . | |
| 4,708,252 | 11/1987 | Azzi | 108/108 |
| 4,716,841 | 1/1988 | Suttles . | |
| 4,964,020 | 10/1990 | Savage et al. | 211/190 X |
| 5,022,541 | 6/1991 | White | 108/108 X |

*Primary Examiner*—Jose V. Chen

*Attorney, Agent, or Firm*—Howson and Howson

[57] ABSTRACT

A beverage aisle unit is designed to link together end-to-end with commonly shared uprights supporting adjacent shelves and back panels. Each upright includes a series of vertical slots in a recess opening outward from the uprights to receive shelf brackets with hook portions projecting inwardly for attaching the shelves in the slots at selected elevations. The hook portions are completely inserted to provide an unobstructed juncture between adjacent back panels. Slotted adapters slidable onto each upright enable mounting of back panels and shelves on the opposite side. The slots are of sufficient width to permit adjacent bracket hook portions to share the same slot in an end-to-end unit arrangement. The base of the uprights may extend from one or both sides of the upright. An alternate embodiment includes symmetrical flanges and recessed slots on both sides of the upright for mounting like shelves and panels on either side of a unit.

20 Claims, 6 Drawing Sheets

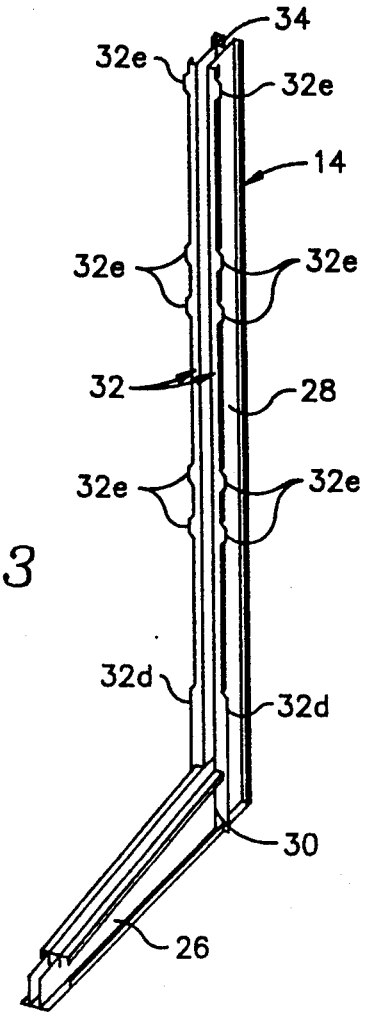
Fig. 3
Fig. 5
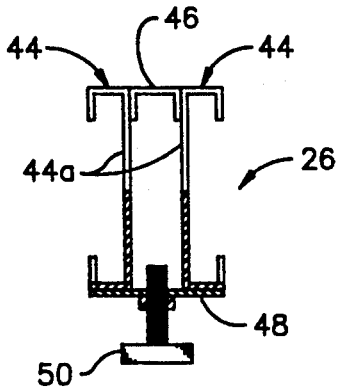
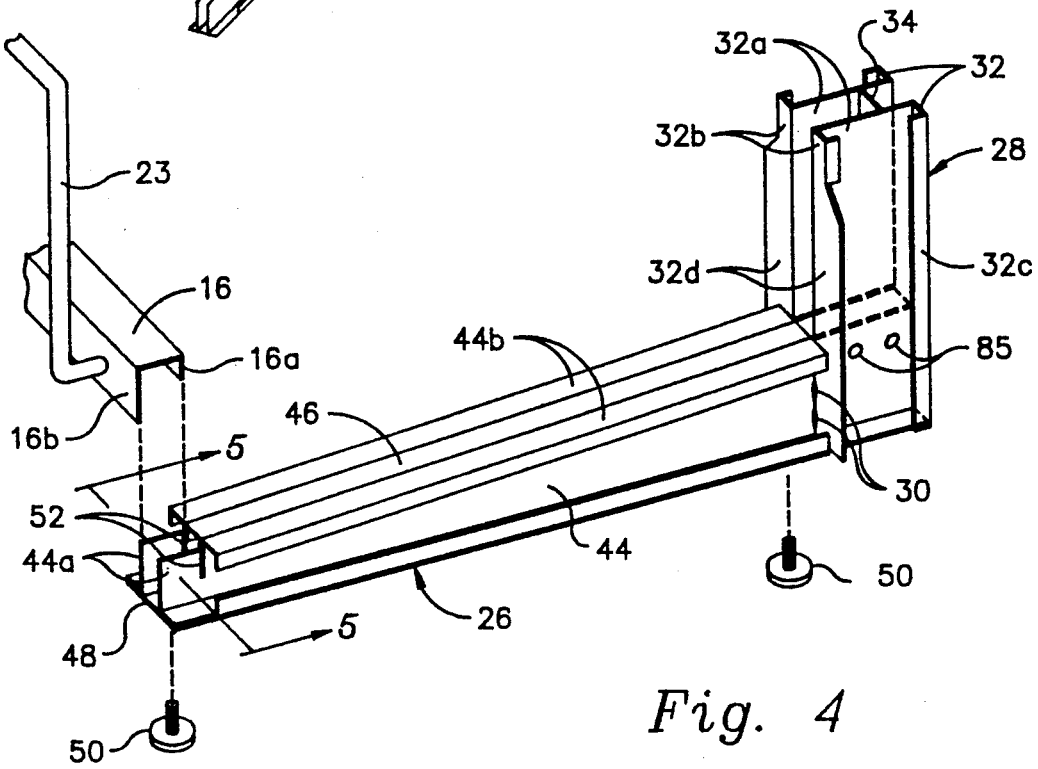
Fig. 4

Fig. 9
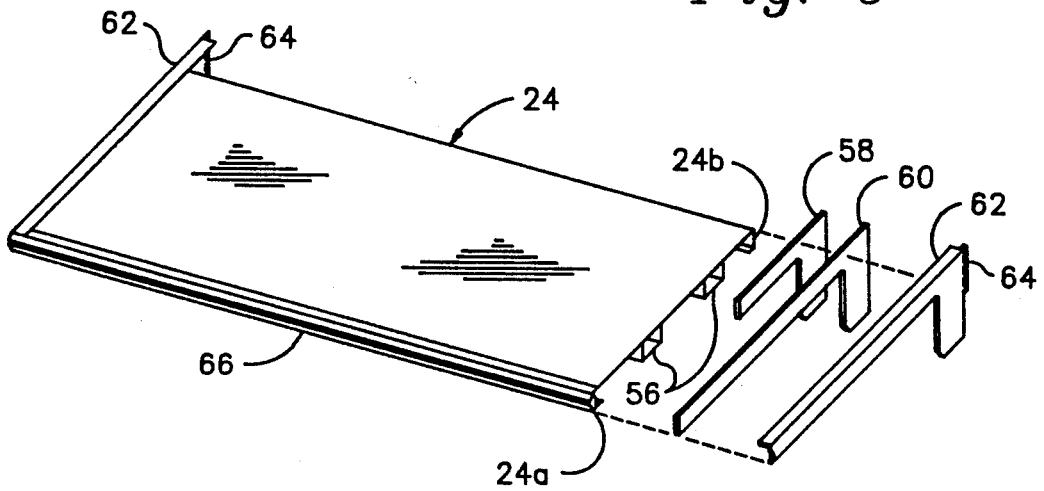
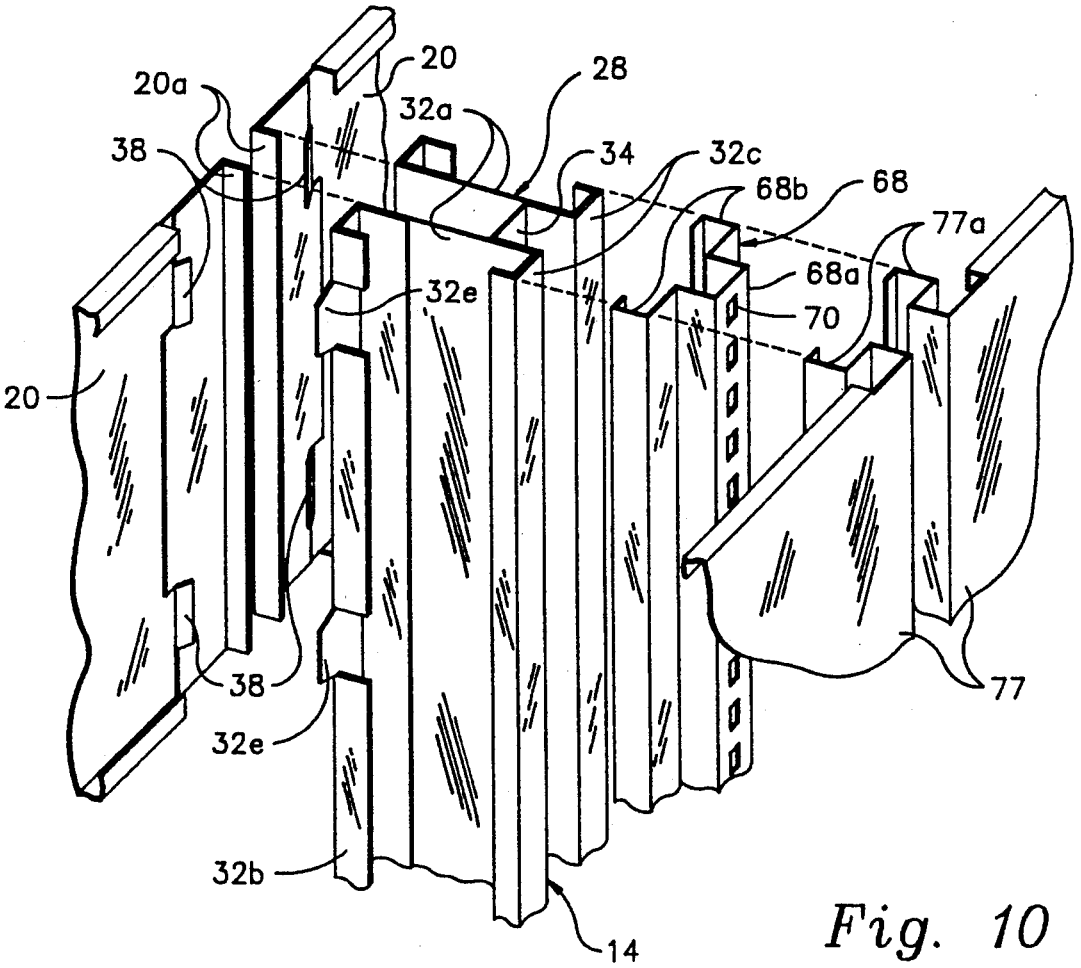
Fig. 10

BEVERAGE AISLE UNIT

BRIEF SUMMARY OF THE INVENTION

The present invention relates generally to shelving fixtures or gondolas used typically in self-service retail stores to display various forms of merchandise, and more particularly to an improved beverage aisle unit which can be erected, alone or in combination with existing store shelving, in various configurations for high density merchandise display.

Prior art gondolas for merchandise display are generally designed for assembly as individual stand-alone units which can be arranged end-to-end in rows to form aisles in supermarkets, convenience stores and similar retail establishments. The shelves are supported at their ends on cantilevered wedge-shaped brackets with inwardly projecting hooks engaging selected ones of a vertical series of slots in upright supports at each end of the gondola. When gondolas are arranged end-to-end, there is duplication of upright supports where they abut. Moreover, the brackets protrude below the shelves where they attach to the upright supports and prevent merchandise on the lower shelves from placement continuously across the shelf junctions. Valuable shelf space is therefore lost.

High density display of certain products is also lost due to inappropriate spacing of the standard grocery store slot pattern adopted by many supermarkets and convenience stores. The slot spacing is usually uniform throughout the store, but may not be suitable for certain products such as beverages. Consequently "packout" space is wasted because the minimum number of slots required for a given product height none the less produces excess clearance between the product and the shelf above.

Accordingly, it is an object of the present invention to provide a beverage aisle unit which is suitable for use in self-service stores, and which can stand alone or can be positively linked with others by shared components.

Another object is to provide shelves which will allow merchandise to be placed continuously across their junction with other shelves on gondolas linked end-to-end.

Still another object is to provide a gondola which can be assembled with the shelves on opposite sides vertically positioned at different preselected increments for minimum clearance between the top of a product and the shelf above.

A further object is to provide a gondola which can be assembled with shelving on opposite sides for displaying like products in adjacent aisles.

A still further object is to provide a gondola which can be assembled in various configurations for side-by-side or back-to-back high density display of merchandise.

Briefly, these and other objects are accomplished with gondola units designed to link together end-to-end with commonly shared uprights supporting adjacent shelves and back panels. Each upright includes a series of vertical slots in a recess opening outward from the uprights to receive shelf brackets with hook portions projecting inwardly for attaching the shelves to the slots at selected elevations. The width of the slots is sufficient to permit adjacent brackets to share the same slot. The hook portions of the brackets are completely inserted to provide an unobstructed juncture between adjacent back panels. Slotted adapters slidable onto each upright enable mounting of back panels and shelves on the opposite side. The base of the uprights may extend from one or both sides of the upright.

For a better understanding of these and other objects of the invention, reference will be made to the following detailed description taken in conjunction with the accompanying drawings.

BRIEF DESCRIPTION OF THE DRAWINGS

FIG. 3 is a more detailed perspective view of an L-post assembly of FIG. 2;

FIG. 4 is an enlarged perspective view of a base member of the L-post assembly of FIG. 3;

FIG. 5 is a sectional view of the base member taken in a vertical plane along the line 5—5 of FIG. 4;

FIG. 9 is a perspective view of an upper shelf of the unit of FIG. 2;

FIG. 10 is an exploded fragmentary view in perspective taken from the opposite side of the unit of FIG. 2 with an adapter and back panels according to the invention for adding existing store shelves;

DESCRIPTION OF THE PREFERRED EMBODIMENTS

Figure 1:
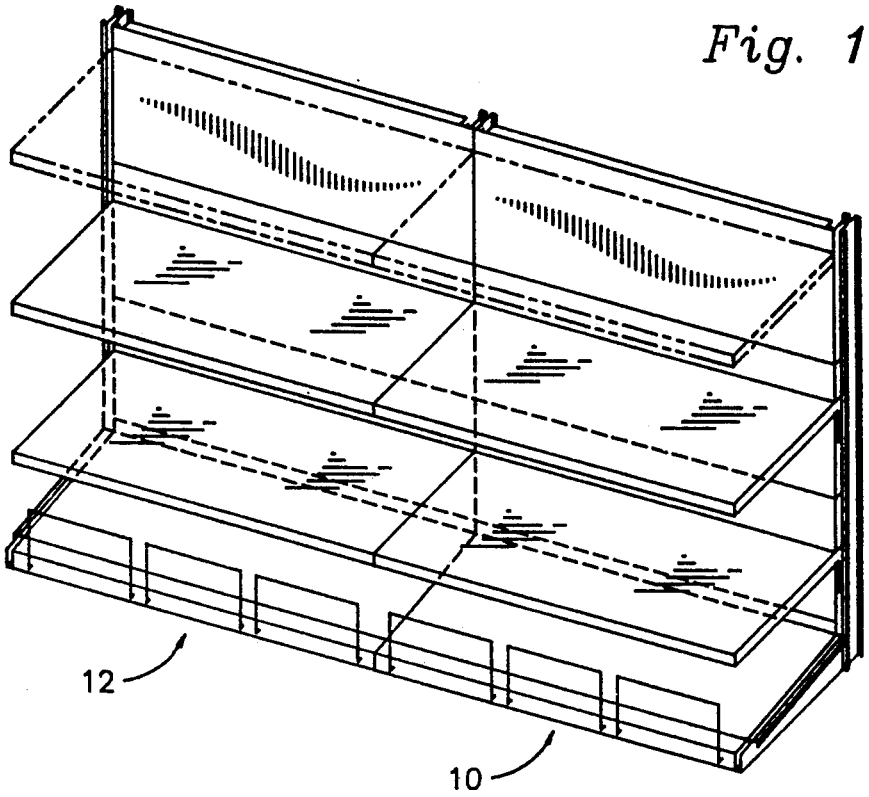
FIG. 1 is a simplified perspective view of two L-post beverage aisle units assembled and connected end-to-end according to the invention.
Figure 2:
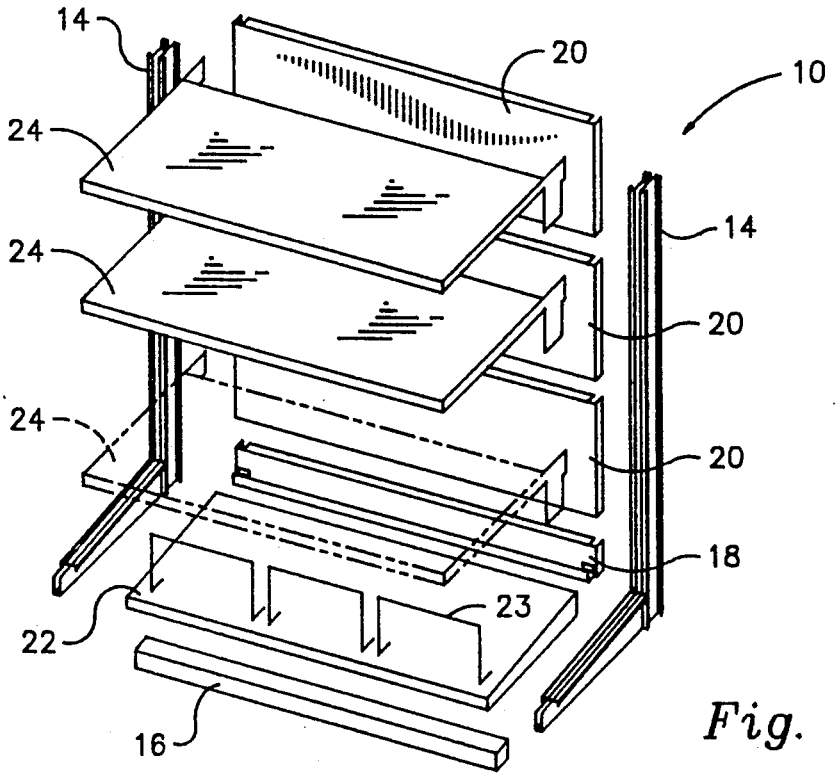
FIG. 2 is a perspective view of one of the beverage aisle units of FIG. 1 in a disassembled array for revealing discrete components.

Referring now to the drawings wherein like characters designate like or corresponding parts throughout the several views, there is shown in FIG. 1 two L-post beverage aisle units 10 and 12 completely assembled and linked end-to-end for display of beverages in a self-service retail store. Referring to the exploded view of unit 10 in FIG. 2, two upright L-post assemblies 14 are connected in parallel-spaced relation by an outer spreader 16 and inner spreader 18, three back panels 20, a tilted base shelf 22 and three horizonal upper shelves 24. The components of unit 12 are identical to those in unit 10 except where they share the same L-post assembly 14 when linked together with unit 10. Additionally linked beverage aisle units, not shown, would share L-post assemblies 14 in like manner.

Although pairs of shelves 24 are shown in FIG. 1 in planar alignment, the height of each shelf 24 is independently adjustable. As illustrated, base shelf 22 slopes down and outward allowing rows of beverage containers to feed outwardly by gravity as a customer removes the outermost container. Upright wireform fences 23 mounted along the front of outer spreader 16 prevent the containers from sliding off. Of course, other shelf configurations and arrangements are contemplated. For example, upper shelves 24 may also slope down and outwardly, and include wireform fences like base shelf 22. Base shelf 22 may also be rotated front-to-back provide a horizontal shelf surface as will be described hereinbelow.

Figure 7:
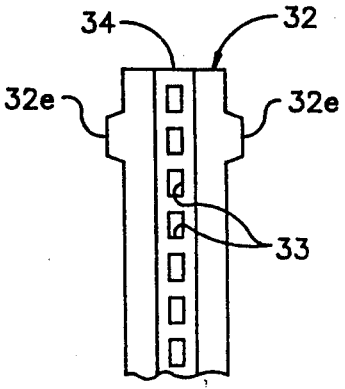
FIG. 7 is an elevation view of the upper end of the L-post assembly of FIG. 3.

L-post assemblies 14 provide vertical support for shelves 22 and 24. Referring to FIGS. 3 and 4, each assembly 14 includes an outwardly tapered base member 26 secured by weldments 30 to the lower end of an upright member 28. Upright member 28 is preferably constructed of two parallel U-shaped channels 32 of heavy gage sheet metal connected back-to-back at their webs 32*a* on the sides of a U-shaped spacer channel 34 disposed intermediate of front and rear flanges 32*b* and 32*c*. The web of spacer channel 34 includes a vertical series of slots 33 (FIG. 7) evenly spaced along the length of upright member 28.

Figure 6:
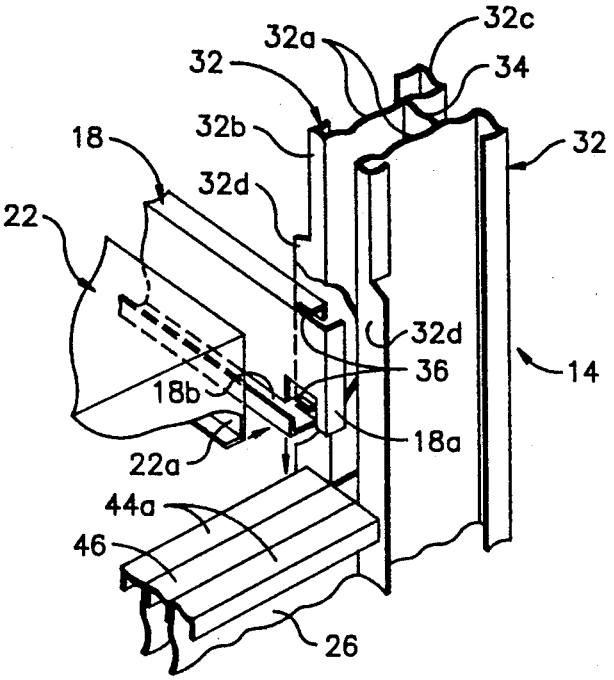
FIG. 6 is an enlarged exploded view in perspective of portions of an inner spreader, a base shelf, and the L-post assembly of FIG. 3.

Inner spreader 18 is secured to upright members 28 and abuts the top surfaces of base member 26. Retainer slots 36 (FIG. 6) formed in both ends of spreader 18 slidably register with tabs 32*d* which extend outwardly from the lower portion of front flange 32*b*. Back panels 20 are secured to upright members 28 by retainer clips 38 (FIG. 10) formed at both ends of panels 20 which slidably register with tabs 32*e* extending outwardly at spaced intervals along the length of front flange 32*b*. Edge flanges 18*a* and 20*a* (FIG. 10) at each end of spreader 18 and panels 20, respectively, interface with the back side of web 32*a* to retain tabs 32*d* and 32*e* in slot 36 and clips 38, respectively.

Units 10 and 12 may be constructed in different overall vertical heights according to display needs. This is accomplished merely by selecting L-post assemblies 14 and a spreader 18 of different heights. The vertical dimensions of the back panels 20 would remain unchanged.

As best illustrated in FIGS. 4 and 5, base member 26 is constructed of two parallel-spaced U-shaped channels 44 connected back-to-back at their webs 44*a* by an inverted U-shaped spacer channel 46 and a bottom plate 48. Screw-type levelers 50 at the outer and inner ends of bottom plate 48 provide for vertical positioning of the unit as it is installed. Webs 44*a* extend beyond the inner ends of lateral flanges 44*b* and terminate between webs 32*a* of channels 32. Thusly, flanges 44*b* provide a seat for the ends of spreader 18 when flanges 32*d* are fully inserted in retainer slots 36. The webs 44*a* also extend beyond the outer ends of flanges 44*b* and spacer channel 46 and include vertical slots 52 opening at the top for receiving outer spreader 16. Spreader 16 defines an inverted U-shaped channel having a short inner flange 16*a* inserted in the adjacent one of slots 52, and a long outer flange 16*b* abutting the outer end of the adjacent web 44*a*.

Figure 8:
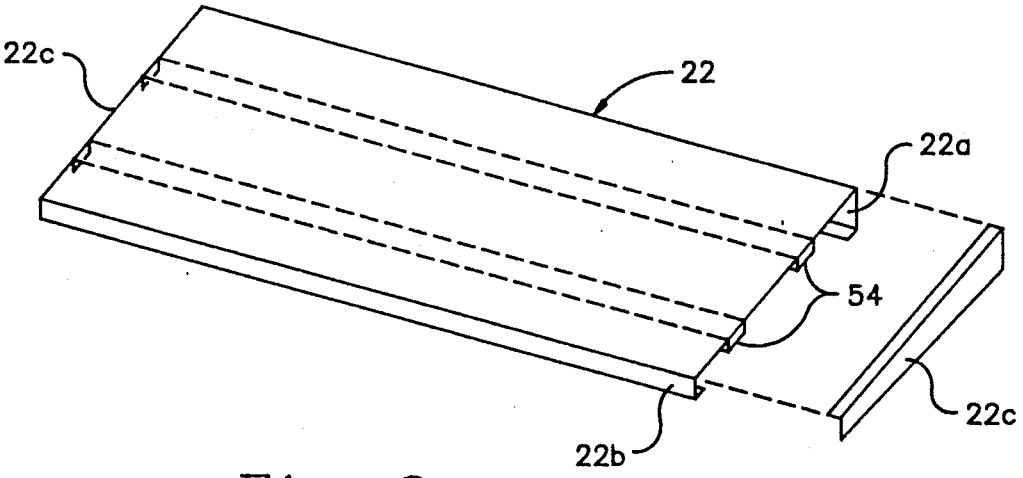
FIG. 8 is a perspective view of the base shelf of the unit of FIG. 2.
Figure 11:
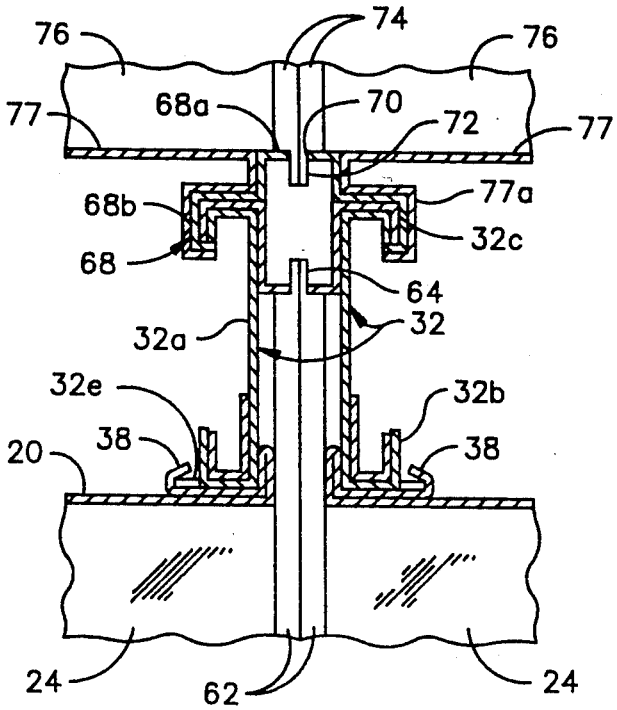
FIG. 11 is a sectional view taken in a horizontal plane across the components illustrated in FIG. 10 with corner portions of shelves mounted on opposite sides of the unit of FIG. 2.

Base shelf 22 is designed to provide either a flat or forwardly tilting merchandise support surface. Referring to FIG. 8, base shelf 22 has inner and outer edge flanges 22*a* and 22*b*. Inner flange 22*a* is wider than outer flange 22*b* to provide a base shelf taper corresponding to the taper of base member 26. With flange 22*a* seated on a ledge 18*b*, which extends outward from the bottom of inner spreader 18, an outward tilt is provided for gravity feeding rows of beverages outward. For example, a preferred taper of 3½° for base member 26 and shelf 22 will therefore provide a 7° downward and outward slope. Rotating shelf 22 180° to seat flange 22*b* in channel 18*b* will provide a horizontal bottom display surface. U-shaped channels 54 extending lengthwise across the bottom of shelf 22 and tapered flanges 22*c* congruently fixed to the ends of base shelf 22 provide supplemental stiffening.

Referring to FIG. 9, the ends of each upper shelf 24 include "stacked" or layered L-shaped brackets 58, 60 and 62, each having arms secured to each end of shelf 24 and cantilevered from bases are inserted in the outwardly opening recesses formed between the opposed surfaces of webs 32*a* in upright members 28. The outermost brackets 62 have hooks 64 projecting inwardly from the bases and engage selected ones of slots 33 in spacer channel 34. The width of slots 33 is sufficient to permit adjacent brackets 62 to share the same slot when units 10 or 12 are joined end-to-end. The widths of the bases are limited to the depth of the recesses thus insuring complete insertion and a flush, unobstructed juncture across adjacent back panels 20. Channels 56 and end edge flanges 24*a* and 24*b* provide lengthwise stiffening of the shelves. A card channel 66, fastened on the outer flange 24*a*, displays product and pricing information.

FIGS. 10–13 illustrate components which may be attached to the opposite side of beverage aisle unit 10 or 12 for supporting existing grocery store shelves having a different bracket hook spacing. Slide-on adapters 68 (FIGS. 10 and 11), each characterized by a U-shaped web 68*a* and opposed U-shaped flanges 68*b* at the ends, slide onto rear flanges 32*c* of channels 32. A vertical series of slots 70 in web 68*a* are spaced to receive hooks 72 (FIG. 11) projecting from the inward ends of brackets 74 of shelves 76. Side-by-side back panels 77 are secured at their ends between upright members 28 by flanges 77*a* formed to slide along the outer sides of channels 68*a* and 68*b*. Adapter 68 can be configured to mate with panel edge configurations corresponding to those on the edges of back panels 20.

Figure 12:
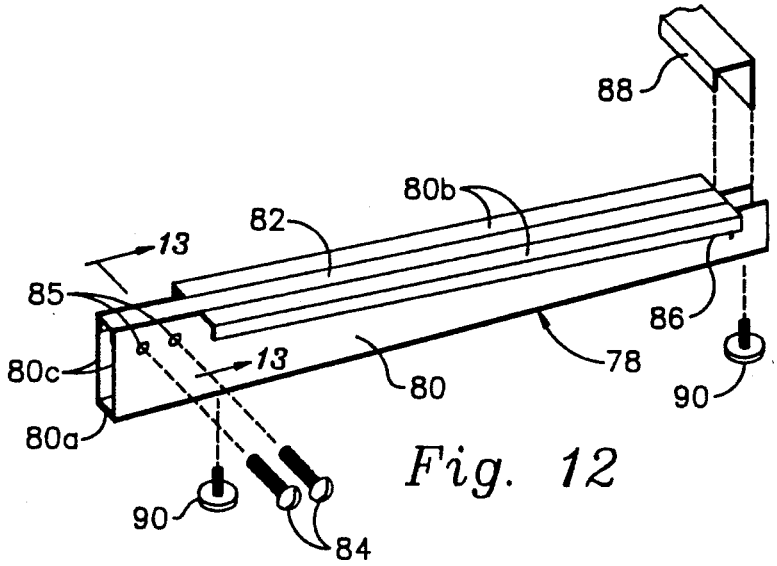
FIG. 12 is an enlarged perspective view of an auxiliary base member according to the invention suitable for attaching to the opposite side of FIG. 2.
Figure 13:
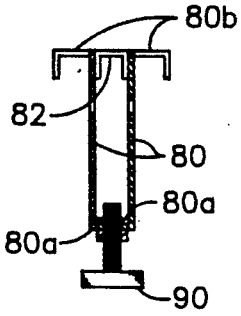
FIG. 13 is a sectional view of the auxiliary base member taken in a vertical plane along the line 13—13 of FIG. 12.

When shelves are added to the opposite sides of L-post assembly 14, an outwardly tapered auxiliary base member 78, as shown in FIGS. 12 and 13, is fastened to the base member 26. Auxiliary base members 78 each include two outwardly tapered Z-shaped webs 80 fixed in parallel-spaced relation by overlapping bottom flanges 80*a* and an inverted U-shaped channel 82 with its web flush with outwardly extended top flanges 80*b*. Webs 80 include inward ends 80*c* which fit between the inner ends of web 44*a* for attachment by bolts 84 through aligned holes 85. The outward portions of web 80 include slots 86 for receiving an outer spreader 88 in the manner described above for outer spreader 16. Screw-type levelers 90 are also provided in the manner described above for levelers 50.

Figure 14:
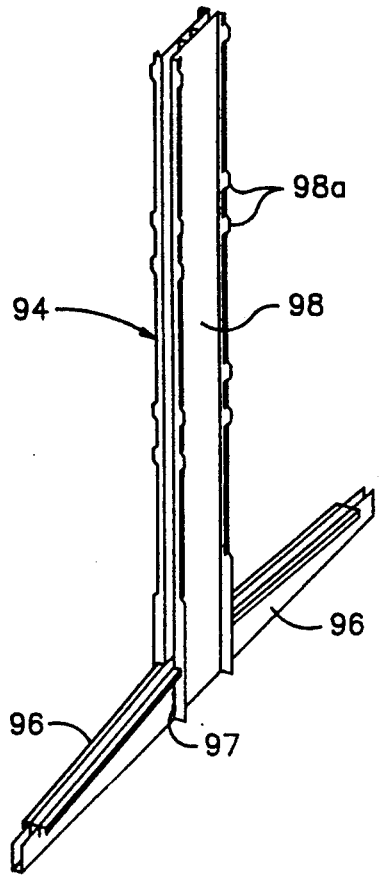
FIG. 14 is a perspective view of a T-post assembly for use in an alternate embodiment of a beverage aisle unit according to the invention.
Figure 15:
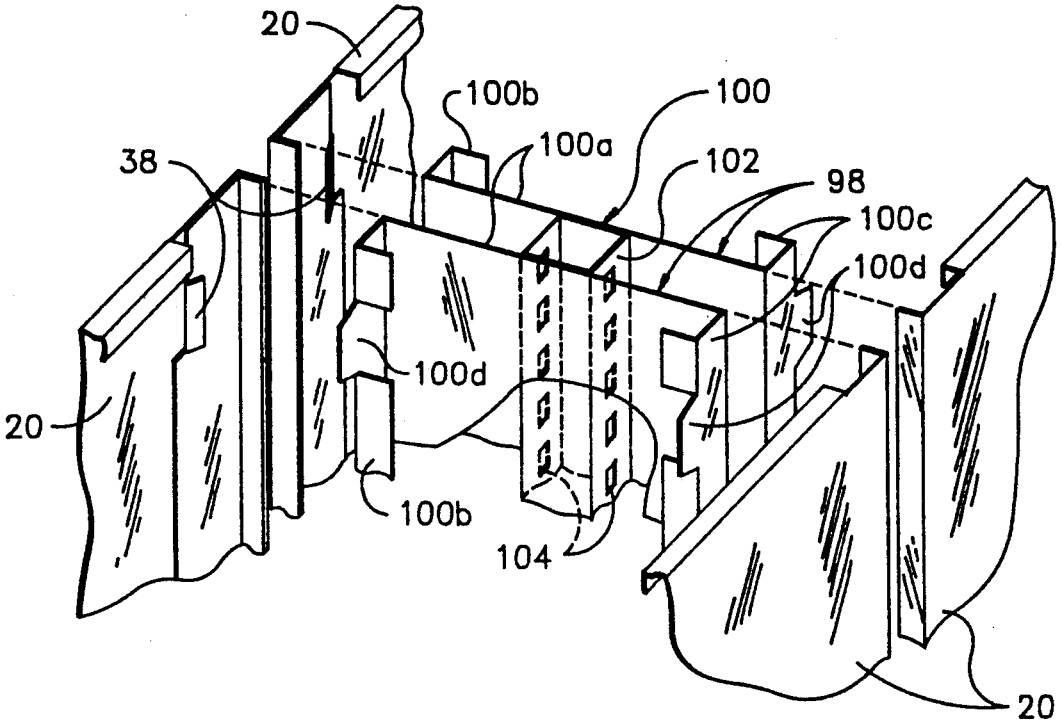
FIG. 15 is an exploded fragmentary view in perspective of the T-post assembly of FIG. 14 with back panels on both sides.

An alternative embodiment of the invention is provided for displaying beverages on opposite sides of a single unit with the same slot spacing. Each L-post assembly 14 is replaced by a T-post assembly 94 as shown in FIGS. 14 and 15. Each assembly includes two opposed, outwardly tapered base members 96, constructed in the manner of member 78, secured by weldments 97 to the bottom of an upright member 98. Upright member 98 consists of two parallel U-shaped channels 100 connected back-to-back at their webs 100*a* by a hollow rectangular spacer bar 102 fixed midway between front and rear flanges 100*b* and 100*c*. The outwardly opening recesses formed between webs 100*a* allow the bases of shelf brackets 58, 60 and 62 to be inserted with hooks 64 interengaging slots 104 equally spaced along the opposite sides of spacer bar 102. Like slots 33, the width of slots 104 permits adjacent hooks 64 to share the same slot. Tabs (not shown) are located at the bottom of upright member 98 slidably engage slots 40 of spreader 18 in the manner described for tabs 32*d* of FIG. 4, and clips 100*d* spaced along member 98 engage tabs 38 on the ends of a back panels 20 in the same manner described above.

As is apparent from the foregoing description, the unique design of various components for the gondola enables it to be assembled in various configurations for high density display of merchandise. In one embodiment of an L-post gondola according to the invention, a shelving arrangement is provided for beverage displays on one side and for attachment of existing grocery shelves on the opposite side. The gondola may be linked end-to-end to other gondolas utilizing commonly shared support members and with flush, unobstructed junctions at the shelves and back panels. Upright T-post assemblies can be substituted for the L-post assemblies to provide a stand-alone gondola with back-to-back shelving for beverages on opposite sides.

It will be understood that various other changes in the details, steps and arrangement of parts which have been herein described and illustrated in order to explain the nature of the invention, may be made by those skilled in the art within the principle and scope of the invention as expressed in the appended claims.

I claim:

1. An aisle unit for display of beverages and like merchandise, and suitable for stand-alone assembly or end-to-end assembly with adjacent units, comprising in combination:

a pair of parallel-spaced posts, each post comprising a pair of unitary upright members in opposing, spaced, relation to each other, the upright members having upper and lower ends, a first base member fixed to and extending outwardly from the lower ends of said upright members, and a discrete, unitary spacer means, having a vertical series of slots in equally spaced increments, connected from one to the other of the upright members of each pair of said upright members, and, with said upright members, forming a recess; and shelves disposed in vertically spaced relation between said upright members, each of said shelves having brackets with inwardly projecting hook portions substantially completely inserted in the recesses formed between the upright members of the posts and interengaging selected ones of the slots in the spacer means of the posts.

2. An aisle unit according to claim 1 wherein:

said slots are of sufficient width to permit adjacent shelf brackets of an end-to-end assembly to share the same slot.

3. An aisle unit according to claim 1 wherein:

each of said upright members includes tabs extending at vertically spaced intervals from opposite sides of said recesses; and having elongate inner spreader means connected at opposite ends thereof between the lower ends of said upright members, said opposite ends having slots slidably connected to proximal ones of said tabs for retaining said upright members in fixed relation.

4. An aisle unit according to claim 3 further comprising:

panel means, disposed between said posts and along the lengths thereof, having clips formed at opposite ends slidably connected to proximal ones of said tabs for providing a back wall.

5. An aisle unit according to claim 3 further comprising:

ledge means extending outwardly from the bottom edge of said inner spreader means; and base shelf means having ends mounted on said first base members and an inner edge secured to said ledge means.

6. An aisle unit according to claim 1 further comprising:

a second base member optionally attached to each of said posts oppositely of said first base member; and adapter means optionally slidably secured lengthwise to each of said upright members opposite from said recess, said adapter means including a series of vertically-spaced slots formed to be connected to inwardly projecting bracket hooks of an existing shelf.

7. An aisle unit according to claim 6 wherein:

said slots of said upright members and of said adapter means are of sufficient width to permit adjacent shelf brackets of an end-to-end assembly to share the same slot.

8. An aisle unit according to claim 6 having:

panel means disposed between said upright members and along the lengths thereof, said panels having attachment configurations along vertical edges thereof; and wherein said adapter means includes outer surface means mating with said back panel attachment configurations.

9. A gondola for merchandise display suitable for end-to-end assembly with adjacent gondolas comprising in combination:

a pair of parallel-spaced L-post assemblies, each of said assemblies having an upright member and a first base member fixed to and extending outward from the lower end of said upright member, said upright member having a series of slots in equally spaced increments in a recess along the length thereof, and a series of tabs extending from opposite sides of said recess at spaced intervals;

an inner spreader having opposite ends with slots slidably connected to proximal ones of said tabs for retaining the lower ends of said upright members in fixed relation; and upper shelves disposed in spaced relation along the lengths of said upright members, each end of said shelves having brackets with inwardly extending hook portions completely inserted in said recesses and engaged in selected ones of said slots.

10. An aisle unit according to claim 9 wherein:

said slots are of sufficient width to permit adjacent shelf brackets of an end-to-end assembly to share the same slot.

11. A gondola according to claim 9 further comprising:

an outer spreader having opposite ends connected to the proximal outer ends of said first base members for retaining said first base members in parallel relation.

12. A gondola according to claim 9 further comprising:

said inner spreader includes an outward ledge along the bottom side thereof; and a base shelf having opposite ends supported on said base members, an inner side secured to the ledge of said inner spreader, and an outer side supported on said outer spreader.

13. A gondola according to claim 9 further comprising:

back panels disposed side-by-side between said upright members, each panel having opposite ends with clips slidably connected to proximal ones of said tabs.

14. An improved upright assembly for a stand-alone or end-to-end arrangement of beverage aisle units having spreaders, back panels and shelves formed to be mounted on said assembly, the improvement comprising:

a pair of elongate U-shaped channels having parallel-spaced webs and a first pair of flanges oppositely extending from one side of said webs at spaced intervals for mating with end flanges of spreaders and back panels mounted on the one side; and spacer means connected between said webs and having a first series of slots formed along the length thereof, said spacer means forming with said channels a recess opening on the one side between said first pair of flanges for total insertion of projecting portions of end brackets of the shelves and for interengagement of hooks thereof in said first series of slots.

15. An aisle unit according to claim 14 wherein:

said slots are of sufficient width to permit adjacent shelf brackets of an end-to-end assembly to share the same slot.

16. The improvement according to claim 14, comprising:

first support means secured to one end of said channels and extending outwardly from said one side of said webs for vertically stabilizing said assembly.

17. The improvement according to claim 14 further comprising:

a second pair of flanges oppositely extending from the other side of said webs; and adapter means slideable over said second pair of flanges for mating with end flanges of the spreaders and back panels mounted on the other side, said adapter means having a second series of slots along the length thereof for interengagement of hooks on end brackets of shelves mounted on the other side.

18. The improvement according to claim 14 further comprising:

a second pair of flanges oppositely extending from the other side of said webs at spaced intervals for mating with end flanges of spreaders and back panels on the other side; and a second series of slots formed in said spacer means along the length thereof;

said spacer means forming with said channels a recess opening on the other side between said second pair of flanges for total insertion of protecting portions of end brackets of the shelves and for interengagement of hooks thereof in said second series of slots.

19. An aisle unit according to claim 18 wherein:

said slots are of sufficient width to permit adjacent shelf brackets of an end-to-end assembly to share the same slot.

20. The improvement according to claim 18 further comprising:

a second support means secured to said one end of said channels and extending outwardly from the other side of said webs for vertically stabilizing the assembly.

* * * * *